US007867564B2

(12) United States Patent
Imori et al.

(10) Patent No.: US 7,867,564 B2
(45) Date of Patent: Jan. 11, 2011

(54) METAL PLATING METHOD AND PRETREATMENT AGENT

(75) Inventors: Toru Imori, Kitaibaraki (JP); Atsushi Yabe, Kitaibaraki (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 1309 days.

(21) Appl. No.: 10/482,092

(22) PCT Filed: Aug. 5, 2003

(86) PCT No.: PCT/JP03/09968

§ 371 (c)(1),
(2), (4) Date: Dec. 19, 2003

(87) PCT Pub. No.: WO2004/024984

PCT Pub. Date: Mar. 25, 2004

(65) Prior Publication Data

US 2005/0147755 A1 Jul. 7, 2005

(30) Foreign Application Priority Data

Sep. 10, 2002 (JP) ..... 2002-263736

(51) Int. Cl.
*B05D 3/10* (2006.01)
*C23C 18/18* (2006.01)
*C23C 18/28* (2006.01)
*C23C 18/30* (2006.01)

(52) U.S. Cl. ..... 427/304; 427/305; 427/306; 106/1.05; 106/1.11

(58) Field of Classification Search ..... 427/304
See application file for complete search history.

(56) References Cited

U.S. PATENT DOCUMENTS 6,710,181 B2 * 3/2004 Kumagai et al. ..... 548/110
6,780,467 B2 * 8/2004 Imori ..... 427/304
7,045,461 B2 * 5/2006 Imori et al. ..... 438/678
2002/0192379 A1 * 12/2002 Imori ..... 427/304
2003/0088108 A1 * 5/2003 Kumagai et al. ..... 548/110
2006/0233963 A1 * 10/2006 Imori et al. ..... 427/437

FOREIGN PATENT DOCUMENTS

| | | | |
|---|---|---|---|
| EP | 1279750 | A1 | 1/2003 |
| JP | 59-52701 | | 12/1984 |
| JP | 60-181294 | | 9/1985 |
| JP | 61-194183 | | 8/1986 |
| JP | 3-44149 | | 7/1991 |
| JP | 6-256358 | | 9/1994 |
| JP | 2002-47573 | | 2/2002 |
| JP | 2002-161389 | | 6/2002 |
| JP | 2002-226972 | | 8/2002 |
| KR | 2002 0022643 | | 3/2002 |
| WO | WO 00/01862 | | 1/2000 |
| WO | WO 01/49898 | | 7/2001 |
| WO | WO 01/77119 | | 10/2001 |
| WO | WO 01 81652 | | 11/2001 |
| WO | WO 01/81652 | A1 | 11/2001 |

OTHER PUBLICATIONS

Translation of WO 01/77119, published Oct. 18, 2001.*
Translation of WO 01/81652, published Nov. 1, 2001.*
Improved Adhesion Between Kapton Film and Copper Metal by Silane-Coupling Reactions, Inagaki, et al., Journal of Applied Polymer Science, 1999, pp. 1645-1654.

* cited by examiner

*Primary Examiner*—Katherine A Bareford
(74) *Attorney, Agent, or Firm*—Flynn, Thiel, Boutell & Tanis, P.C.

(57) ABSTRACT

The object of the present invention is to provide a metal plating method by a simple process, for example, on resins on which plating has been heretofore impossible. The metal plating method involves surface treating an article to be plated with a liquid prepared by mixing or reacting in advance an organic acid salt of a silane coupling agent containing an azole in a molecule, for example, a coupling agent which is an equimolar reaction product of imidazole and γ-glycidoxypropyltrimethoxysilane, and a noble metal compound, and then conducting electroless plating thereon.

7 Claims, No Drawings

METAL PLATING METHOD AND PRETREATMENT AGENT

TECHNICAL FIELD

The present invention relates to a method for plating a metal by an electroless plating process on the surface of materials with a low electric conductivity, mirror-surface articles, or powders.

BACKGROUND ART

An electroless metal plating method is one of the methods for forming a metal film on a base surface having no electric conductivity and this method generally comprises the so-called activation by causing a noble metal such as palladium to adhere in advance as a catalyst to the base surface, as a pretreatment for electroless plating. Methods comprising the steps of treating with an aqueous hydrochloric acid solution of $SnCl_2$ followed by immersing in an aqueous solution of $PdCl_2$, thereby causing the adsorption of Pd, or supporting Pd on the surface by using a colloidal solution comprising Sn and Pd have been heretofore employed. However, a large number of problems associated with the usage of a highly toxic Sn and complex treatment process are inherent to those methods. Accordingly, a variety of methods using silane coupling agents having a functional group capable of forming a complex with noble metals have recently been suggested as methods for supporting a noble metal such as Pd, which is a catalyst for electroless plating, on the surface (see the patent documents 1-8 listed below). With those of the aforesaid methods in which a plating catalyst fixing agent and a plating catalyst were treated separately, that is, when a coupling agent was caused to be absorbed by the article to be plated and then ions of a noble metal serving as a catalyst were supported, it was sometimes difficult to deposit an adherent uniform plating film on the substrate because the substrate is subjected to surface modification by the coupling agent treatment, or because the noble metal ions could not be effectively supported, depending on the substrate material. Even with the methods using a mixed solution of an aminosilane coupling agent and palladium chloride, for the aforesaid reasons or due to the fact that palladium did not fully demonstrate its catalytic activity, uniform plating could not be conducted depending on materials of plating substrates to be plated and plating conditions.

Patent Document 1: Japanese Patent Publication No. 59-52701B

Patent Document 2: Japanese Patent Publication No. 60-181294A

Patent Document 3: Japanese Patent Publication No. 61-194183A

Patent Document 4: Japanese Patent Publication No. 3-44149A

Patent Document 5: Japanese Patent Publication No. 2002-47573A

Patent Document 6: Japanese Patent Publication No. 2002-161389A

Patent Document 7: Japanese Patent Publication No. 2002-226972A

Patent Document 8: WO01/49898A1

DISCLOSURE OF THE INVENTION

With the foregoing in view, it is an object of the present invention to provide a novel metal plating method based on electroless plating, this method allowing the formation of a uniform adherent electroless plating layer even on powders, mirror-surface articles, or resin cloth, which have difficulties in application of conventional electroless plating, and also to provide a pretreatment agent for this method.

Based on the results of a comprehensive study, the inventors have found that the above-described problems can be resolved by surface treating an article, which is to be plated, with a liquid prepared by mixing or reacting in advance the aforesaid noble metal ion with a silane coupling agent having a complex-forming capability, this coupling agent being in the form of an organic acid salt thereof. This invention was reached on the basis of this finding.

Thus, the present invention is as follows.

(1) A metal plating method comprising surface treating an article, which is to be plated, with a liquid prepared by mixing or reacting in advance an organic acid salt of a silane coupling agent containing an azole in a molecule and a noble metal compound and then conducting electroless plating on the article.

(2) The metal plating method according to (1) above, wherein the silane coupling agent having an azole in a molecule is obtained by a reaction of an azole compound and an epoxysilane compound.

(3) The metal plating method according to (1) or (2) above, wherein the azole is imidazole.

(4) The metal plating method according to any of (1) through (3) above, wherein the noble metal compound is a palladium compound.

(5) A pretreatment agent for metal plating comprising a liquid prepared by mixing or reacting in advance an organic acid salt of a silane coupling agent containing an azole in a molecule and a noble metal compound.

BEST MODE FOR CARRYING OUT THE INVENTION

The present invention relates to a metal plating method comprising surface treating by using a specific compound having in the same molecule a function of trapping noble metal ions serving as a catalyst for electroless plating and a function of fixing them to an article to be plated and then conducting electroless plating. Combining the two functions, i.e., a function of trapping the catalyst and a function of fixing the catalyst to the article to be plated, in the same molecule not only results in a shortened plating process, but also makes it possible to fix the catalyst effectively to the article.

In accordance with the present invention, it is especially important that the specific silane coupling agent be used in the form of an organic acid salt. Thus, when an azole is present in a molecule, the conjugation ability and aromaticity of the azole provide for an electron state and orientation such that the catalyst activity is effectively demonstrated, and because it is a silane coupling agent, adhesion to the article to be plated can be demonstrated. Furthermore, using the silane coupling agent in the form of an organic acid salt can further enhance the adsorption of the noble metal compound to the article to be plated. As a result, electroless plating on the article can be carried out with better uniformity.

When the pretreatment was conducted by using an imidazole, which is an azole compound, but not a silane coupling agent, plating with good uniformity could be conducted, although adhesion of the plated layer to the article was very poor.

Examples of azoles include imidazole, oxazole, thiazole, selenazole, pyrazole, isoxazoles, isothiazole, triazole, oxadiazole, thiadiazole, tetrazole, oxatriazole, thiatriazole, bendazole, indazole, benzimidazole, benzotriazole, and indazole. Those examples are not limiting; among them, the imidazole ring is especially preferred.

The aforesaid silane coupling agent is a compound having a —$SiX_1X_2X_3$ group. $X_1$, $X_2$ and $X_3$ stand for an alkyl group, a halogen, or an alkoxy group. Any functional group that can be fixed to the article to be plated may be used. $X_1$, $X_2$ and $X_3$ may be the same or different.

Thus, the silane coupling agent in accordance with the present invention comprises the aforesaid azole and —$SiX_1X_2X_3$ group in a molecule. Especially preferred, in accordance with the present invention, is a silane coupling agent which is a reaction product obtained by conducting an equimolar reaction of imidazole as the azole compound and γ-glycidoxypropyltrialkoxysilane as the epoxysilane compound (Japanese Patent Publication No. 6-256358).

Further, an organic acid salt of such a silane compound agent can be synthesized by conducting a reaction of a silane coupling agent with an organic acid in an amount equivalent to the amount of the silane coupling agent. This reaction proceeds by bonding the organic acid to the amine of the azole compound and formation of a salt. No specific limitation is placed on the organic acid, provided it can form a salt with an azole, but carboxylic acids such as acetic acid are preferred. From the standpoint of availability and cost, the especially preferred among them is acetic acid.

No solvent is required for the reaction, but an alcohol such as methanol and ethanol may be used. Further, the target compound can be synthesized by conducting the reaction for 0.5-20 hours at a reaction temperature of 50-100° C.

Examples of the aforesaid noble metal compounds include chlorides, hydroxides, oxides, sulfates, and ammine complexes such as ammonium salts of a noble metal such as palladium, silver, platinum, or gold, which demonstrates a catalytic effect in depositing copper, nickel, or the like, on the surface of an article to be plated from an electroless plating solution. The especially preferred among them is palladium chloride. Furthermore, the noble metal compound is used at a concentration in the pretreatment solution of 1-1000 mg/L, preferably 10-200 mg/L.

With the metal plating method in accordance with the present invention, no limitation is placed on the properties of the article to be plated. For example, the method in accordance with the present invention can be applied to inorganic materials such as glass and ceramics, plastic materials such as polyesters, polyamides, polyimides, and fluororesins, in the form of films, sheets, fibers, insulating materials such as insulating sheets, for example, epoxy resin sheets optionally reinforced with a glass cloth material, and articles with a low electric conductivity such as semiconductor elements, e.g. Si wafers. The article to be plated may be in the form of a mirror-surface material such as a transparent glass sheet, a Si wafer, or other semiconductor substrates, or in the form of a powder. Examples of the powdered materials include glass beads, molybdenum disulfide powder, magnesium oxide powder, graphite powder, SiC powder, zirconium oxide powder, alumina powder, silicon oxide powder, mica flakes, glass fibers, silicon nitride powder, and Teflon (trade name) powder.

When the base surface which is to be electroless plated is treated with a liquid obtained by mixing or reacting in advance an organic acid salt of the aforesaid silane coupling agent having an azole in a molecule and a noble metal ion, the liquid can be used in the form of a solution obtained by dissolving in an appropriate solvent such as water, methyl alcohol, ethyl alcohol, 2-propanol, acetone, toluene, ethylene glycol, polyethylene glycol, dimethylformamide, dimethylsulfoxide, and dioxane, or a mixture thereof. When water is used, the pH value of the solution has to be optimized according to the type of the article to be plated and the plating conditions. Where plating is conducted on a cloth- or sheet-like substrate, in a general method, a surface coat is formed, for example, by immersion or brush coating, and the solvent is then evaporated. However, the present invention is not limited to this method, and any method providing for uniform adhesion of the silane coupling agent to the surface can be used. Furthermore, when a powder is to be plated, because the silane coupling agent is capable of forming a uniform film, it can be adsorbed by the base surface during immersion treatment. Therefore, in addition to a method by which a solvent is evaporated after the immersion treatment, thereby forcibly causing the adhesion of the silane coupling agent contained in the solution to the base surface, a method can be also used by which the solvent is filtered out and separated after the treatment and the wetted powder is dried. With certain adhesion states, only washing with water is sometimes sufficient and the drying process can be omitted.

No specific limitation is placed on the concentration of the organic acid salt of the coupling agent having an azole in a molecule in the treatment solution, but a concentration of 0.001-10 wt. % is preferred. When the concentration is less than 0.001 wt. %, the quantity of the compound adhering to the substrate surface easily decreases and any effect can hardly be obtained. Furthermore, when the concentration exceeds 10 wt. %, the amount adhered becomes too large and drying is difficult or cohesion of particles tends to occur.

In order to evaporate the solvent after the surface treatment, it suffices to conduct heating to a temperature of not less than the evaporation temperature of the solvent, thereby drying the surface, but it is preferred that heating be further conducted for 3-60 minutes at a temperature of 60-120° C.

When water is used as the solvent, the drying process can be omitted and plating can be conducted by merely washing with water after the surface treatment. However, in this case, washing with water should be conducted thoroughly, so that no catalyst is taken up by the plating solution.

The pretreatment can be fully conducted at room temperature, but heating is sometimes effective with some articles to be plated.

It goes without saying, that washing of the article to be plated may be conducted prior to the pretreatment. When a high adhesion is especially required, the conventional etching, e.g., with chromic acid may be used.

Sometimes it is effective to conduct treatment with a solution containing a reducing agent prior to plating. In particular, in the case of copper plating, the treatment may be conducted with a dimethylamine-borane solution as a reducing agent.

Furthermore, after a thin metal film has been formed by initial electroless plating and the substrate that was not electrically conductive has been provided with a certain electric conductivity, electroplating or substitution plating with a base metal can be conducted.

With the present invention, metals such as copper, nickel, cobalt, tin, and gold can be plated by an electroless plating process.

The present invention will be described hereinbelow in greater detail based on the examples thereof.

EXAMPLE 1

An acetic acid salt was synthesized by adding acetic acid to an equivalent amount of a silane coupling agent which was an equimolar reaction product of imidazole and γ-glycidoxypropyltrimethoxysilane and stirring for 3 hours at a temperature of 80° C. A plating pretreatment agent with a Si content of 5 mg/L and a Pd content of 15 mg/L was prepared by adding an aqueous solution of palladium chloride to an aqueous solution of the above acetic salt at room temperature. A glass cloth (5×10 cm) was immersed for 5 minutes at a temperature of 60° C. into the liquid thus obtained, followed by thorough washing with water flow. The sample washed with water was air dried and the amount of palladium adhered to the glass cloth was analyzed. After subsequent treatment for 5 minutes at a temperature of 75° C. with a reducing agent (trade name PM-B101, manufactured by Nikko Materials Co., Ltd.) based on sodium hypophosphite, electroless plating with copper was conducted (KC-100 manufactured by Nikko Metal Plating Co., Ltd, was used). The results are presented in the table below. For comparison, the case in which the silane coupling agent was not an acetic acid salt and the case in which no silane coupling agent was used are also described. The pH value of the aforesaid treatment solution was adjusted with sulfuric acid. Data presented in the table demonstrate that when an acetic acid salt was used, the amount of adsorbed Pd could be greatly increased and electroless plating with copper could be conducted uniformly over the entire surface of glass cloth. By contrast, when an acetic acid salt was not used, non-plated portions locally appeared on the glass cloth.

The following symbols are used in the table:

◎: uniform plating over the entire surface;

Δ: non-plated portions are locally present;

x: no plating was made.

Further, in the table, "acetic acid salt" means a silane coupling agent in the form of an acetic acid salt, and "non-acetic acid salt" means a silane coupling agent which was not in the form of an acetic acid salt. Reference numerals 3 and 6 in the table refer to cases in which no silane coupling agent was used.

TABLE 1

| | Acetic acid salt | Non-acetic acid salt | pH | Amount of adhered Pd μg (5 × 10 cm sample) | Electroless plating with copper |
|---|---|---|---|---|---|
| 1 | ○ | . . . | 2.2 | 24 | ◎ |
| 2 | . . . | ○ | 2.2 | 4 | Δ |
| 3 | . . . | . . . | 2.2 | <1 | x |
| 4 | ○ | . . . | 2.6 | 32 | ◎ |
| 5 | . . . | ○ | 2.6 | 8 | Δ |
| 6 | . . . | . . . | 2.6 | <1 | x |

EXAMPLE 2

A plating pretreatment agent was prepared by adding acetic acid to a silane coupling agent which was an equimolar reaction product of imidazole and γ-glycidoxypropyltrimethoxysilane to obtain an acetic acid salt and then adding, to an aqueous solution containing 0.3 wt. % of this acetic acid salt, an aqueous solution of palladium chloride at room temperature to obtain a concentration of 30 mg/L. A wafer patterned with Ta was immersed for 5 minutes at a temperature of 60° C. into the liquid agent, washed with water flow and then immersed for 5 minutes into dimethylamine-borane of 10 g/L which was heated to 60° C. After washing with water, plating with copper was conducted by immersing for 3 minutes in an electroless copper plating solution (KC-500 manufactured by Nikko Metal Plating Co., Ltd.). As a result, a uniform adherent copper plating film was formed on the wafer (the adhesion force was confirmed by a tape peeling test).

COMPARISON EXAMPLE 2

Electroless copper plating was conducted in the same manner as in Example 2, except that an aqueous solution containing 0.3 wt. % γ-aminopropyltrimethoxysilane (manufactured by Shin-Etsu Chemical Co.) was used instead of the acetic acid salt obtained by adding acetic acid to a silane coupling agent which was an equimolar reaction product of imidazole and γ-glycidoxypropyltrimethoxysilane.

As a result, a copper film was only sparsely obtained.

INDUSTRIAL APPLICABILITY

As described hereinabove, with the novel plating method in accordance with the present invention, plating can be conducted by a simple process, even on substrates that have been conventionally considered unsuitable for plating. Moreover, using a silane coupling agent as an organic acid salt makes it possible to greatly increase the amount of noble metals adhered to an article to be plated and to conduct electroless plating with better uniformity.

The invention claimed is:

1. A metal plating method comprising the steps of surface-treating an article with a liquid prepared by mixing or reacting an organic acid salt of a silane coupling agent containing an azole in a molecule and a noble metal compound and then conducting electroless plating on the surface-treated article.

2. The metal plating method according to claim 1, wherein the silane coupling agent having an azole in a molecule is obtained by a reaction of an azole compound and an epoxysilane compound.

3. The metal plating method according to claim 1, wherein the azole is imidazole.

4. The metal plating method according to claim 1, wherein the noble metal compound is a palladium compound.

5. The metal plating method according to claim 1, wherein acetic acid is used to form the organic acid salt.

6. A pretreatment agent for metal plating comprising a liquid prepared by mixing or reacting an organic acid salt of a silane coupling agent containing an azole in a molecule and a noble metal compound.

7. The pretreatment agent of claim 6, wherein acetic acid is used to form the organic acid salt.

* * * * *